US009343842B2

(12) United States Patent
Tashiro et al.

(10) Patent No.: US 9,343,842 B2
(45) Date of Patent: May 17, 2016

(54) CONNECTOR

(71) Applicant: Yazaki Corporation, Tokyo (JP)

(72) Inventors: Harunori Tashiro, Shizuoka (JP); Kengo Aoshima, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/818,592

(22) Filed: Aug. 5, 2015

(65) Prior Publication Data

US 2015/0340801 A1 Nov. 26, 2015

Related U.S. Application Data

(63) Continuation of application No. PCT/JP2014/052730, filed on Feb. 6, 2014.

(30) Foreign Application Priority Data

Feb. 8, 2013 (JP) ..... 2013-023284

(51) Int. Cl.
*H01R 13/52* (2006.01)
*H01R 13/6581* (2011.01)
*H01R 13/506* (2006.01)

(52) U.S. Cl.
CPC ..... *H01R 13/5205* (2013.01); *H01R 13/506* (2013.01); *H01R 13/6581* (2013.01)

(58) Field of Classification Search
CPC ..... H01R 13/65815; H01R 13/5205
See application file for complete search history.

(56) References Cited

U.S. PATENT DOCUMENTS 5,934,938 A * 8/1999 Clark ..... H01R 13/5208 439/587
2004/0106325 A1* 6/2004 Miyazaki ..... H01R 9/032 439/564
2010/0178805 A1* 7/2010 Yong ..... H01R 13/648 439/607.41
2011/0207354 A1 8/2011 Tashiro
2012/0021632 A1* 1/2012 Matsumoto ..... H01R 13/506 439/271
2012/0100753 A1* 4/2012 Omae ..... H01R 13/5202 439/588

(Continued)

FOREIGN PATENT DOCUMENTS

JP 2011-54393 A 3/2011
JP 2012-226948 A 11/2012
JP 2012-238466 A 12/2012

OTHER PUBLICATIONS

International Search Report for PCT/JP2014/052730 dated Apr. 22, 2014.

*Primary Examiner* — Briggitte R Hammond
(74) *Attorney, Agent, or Firm* — Sughrue Mion, PLLC

(57) ABSTRACT

A connector includes a housing which accommodates terminals connected to end portions of wires therein and which has locking pawls on an exterior surface of the housing; a rear holder having locking frames which are locked with or unlocked from the locking pawls by elastic deformation, in which the rear holder is mounted on a back side of the housing, and prevents rubber plugs that contact an outer periphery of the wires from dropping off the housing; and a shield shell mounted on an outer periphery of the housing to which the rear holder has been mounted. The shield shell includes a rear end portion which is arranged at an elastic deformation region of the locking frames in an assembling process of the rear holder to the housing and obstructs the elastic deformation of the locking frames.

3 Claims, 4 Drawing Sheets

(56) References Cited

U.S. PATENT DOCUMENTS

2012/0202381 A1* 8/2012 Deno ..... H01R 13/648
439/607.41
2012/0270444 A1* 10/2012 Kawamura ..... H01R 9/032
439/607.44
2014/0120767 A1* 5/2014 Itsuki ..... H01R 13/5208
439/607.55
2015/0288090 A1* 10/2015 Shigeta ..... H01R 13/5202
439/587
2015/0364856 A1* 12/2015 Nakai ..... H01R 13/6581
439/587

* cited by examiner

CONNECTOR

CROSS REFERENCE TO RELATED APPLICATIONS

This application is a continuation of International Application No. PCT/JP2014/052730, filed Feb. 6, 2014, and based upon and claims the benefit of priority from Japanese Patent Application No. 2013-023284, filed Feb. 8, 2013, the entire contents of all of which are incorporated herein by reference.

TECHNICAL FIELD

The present application relates to a connector having a shield shell that covers a housing and a rear holder.

BACKGROUND

A conventional connector of this type will be explained by referring to FIG. 5 (refer to U.S. Pat. No. 8,328,572 A2). A conventional connector 100 includes: a housing 110 that accommodates terminals T connected to end portions of wires W; seal members (not illustrated) that contact outer periphery of the wires W within the housing 110; a rear holder 120 which is mounted at the back of the housing 110 and prevents the seal members from dropping off the housing 110; and a shield shell 130 which is mounted on an outer periphery of the housing 110 and prevents intrusion and leakage of electromagnetic noise and the like.

Lock arms (not illustrated) each having an engaging pawl 111 at the tip are provided on the housing 110. Engaging grooves (not illustrated) of the rear holder 120 and engaging grooves 131 of the shield shell 130 are locked to the engaging pawls 111. Thus, the rear holder 120 and the shield shell 130 are mounted to the back of the housing 110.

SUMMARY

However, in the conventional connector 100, since the engaging pawls 111 are exposed outside, there was a possibility that engagement between the engaging pawls 111 and the engaging grooves 131 may be released when the lock arms (not illustrated) are bent by external force and the like.

Here, it can be considered to cover the respective engagement positions with the shield shell 130 so that the engagement state of the engaging pawls 111 and the engaging grooves 131 does not get released. However, in a case that the rear holder 120 is mounted to the housing 110 after the shield shell 130 has been mounted to the housing 110, a mutual engagement state between the engaging pawls 111 and the engaging grooves 131 cannot be grasped and it is difficult to determine whether or not the rear holder 120 has been completely mounted on the housing 110.

The present application was made to solve the above-described problem and its object is to provide a connector in which engagement between a locking part of a housing and a locked part of a rear holder does not get released and a mutual engagement state can be easily determined.

The connector according to a first aspect of the present application includes a housing which accommodates terminals connected to end portions of wires therein and which has a locking part on an exterior surface of the housing; a rear holder having a locked part to be locked with or unlocked from the locking part by elastic deformation, wherein the rear holder is mounted on a side of the housing where the wires are extended, and prevents a waterproofing member that contacts an outer periphery of the wires from dropping off the housing; and a shield shell mounted on an outer periphery of the housing to which the rear holder has been mounted. The shield shell includes an unlocking obstruction part that is arranged at an elastic deformation region of the locked part in an assembling process of the rear holder to the housing and obstructs the elastic deformation of the locked part.

Preferably, the locking part includes a tapered face that causes the locked part elastically deformed and guides the locked part, and a locking face that engages with the locked part that has been guided by the tapered face, and the unlocking obstruction part is arranged above the locking face.

Preferably, a space between an interior surface of the shield shell and a tip of the locking part is smaller than a thickness of the locked part.

With the connector according to the first aspect of the present application, it is possible to prevent releasing of the engagement state between the locking part and the locked part due to external force and the like, by the unlocking obstruction part obstructing the elastic deformation of the locked part. Moreover, by arranging the unlocking obstruction part at the elastic deformation region of the locked part, when the shield shell is mounted to the housing before the rear holder is mounted, the locked part interferes with the unlocking obstruction part and the rear holder cannot be mounted to the housing. That is, it becomes impossible to lock the locking part with the locked part. Therefore, it is necessary that the rear holder is mounted before mounting the shield shell to the housing, and at this time, the engagement state between the locking part and the locked part can be grasped and it can be easily determined whether or not the rear holder has been completely mounted to the housing. As such, the mutual engagement state can be easily determined without releasing the engagement between the locking part and the locked part.

DESCRIPTION OF EMBODIMENTS

Figure 1:
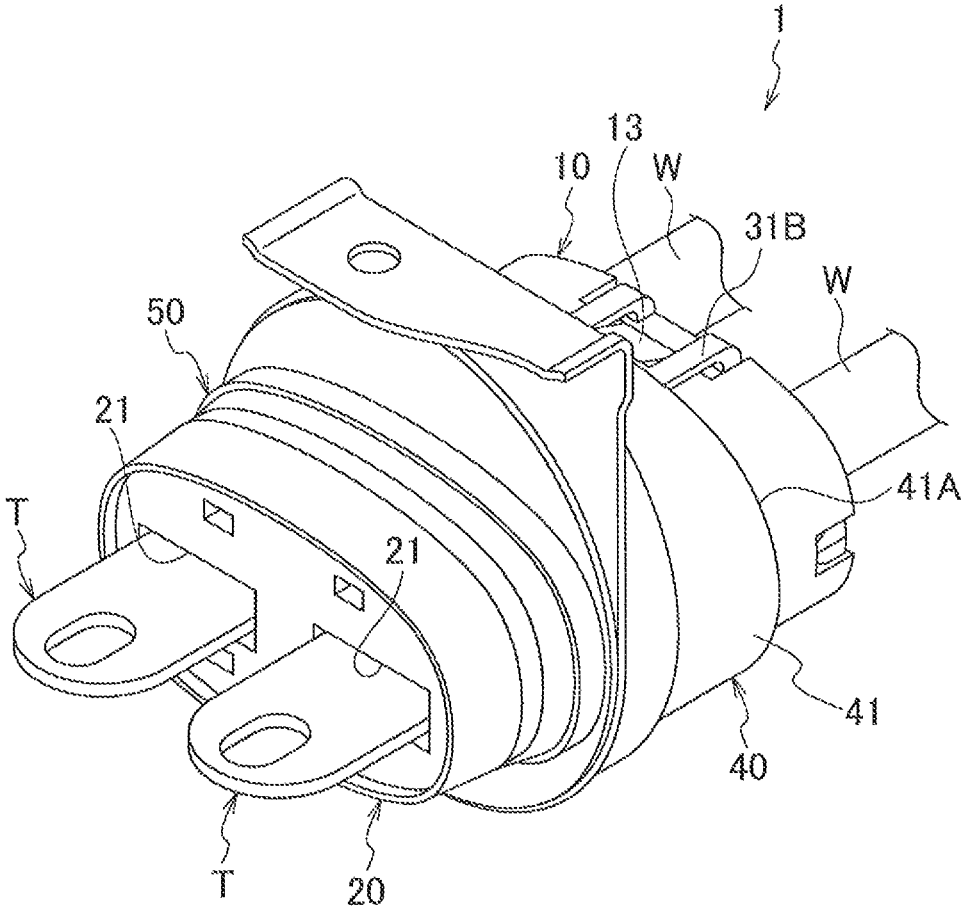
FIG. 1 is a perspective view illustrating a connector according to an embodiment.

Hereinafter, the connector according to an embodiment of the present application will be explained by referring to the drawings. Moreover, in the description of the drawings, the same or similar parts are assigned with the same or similar characters. However, it should be noted that the drawings are schematic and ratios and the like of respective measurements may differ from reality. Therefore, specific measurements and the like should be determined by considering the explanation below. Furthermore, there may also be a part in which a relationship of mutual measurements and ratios may differ among mutual drawings.

A structure of a connector 1 according to the embodiment will be explained by referring to FIGS. 1 to 4. Also, for the convenience of explanation, a side of terminals T provided on end portions of the wires W (a side of a case body (not illustrated) that accommodates a power electronic circuit)

will be referred to as "forward" and a side opposite from the terminals T and where the wires W extend will be referred to as "rearward".

Figure 2:
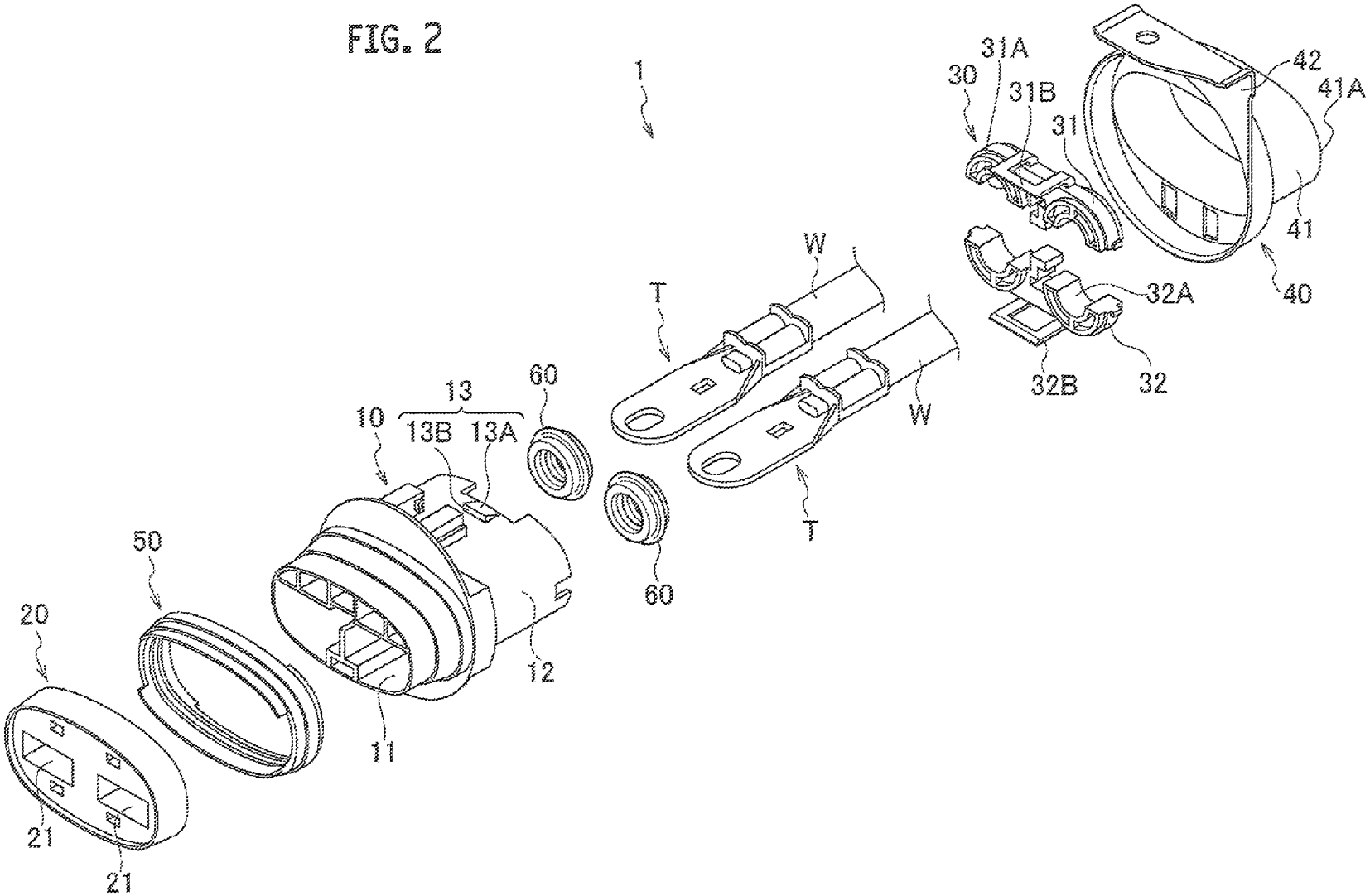
FIG. 2 is an exploded perspective view illustrating the connector according to the embodiment.
Figure 3:
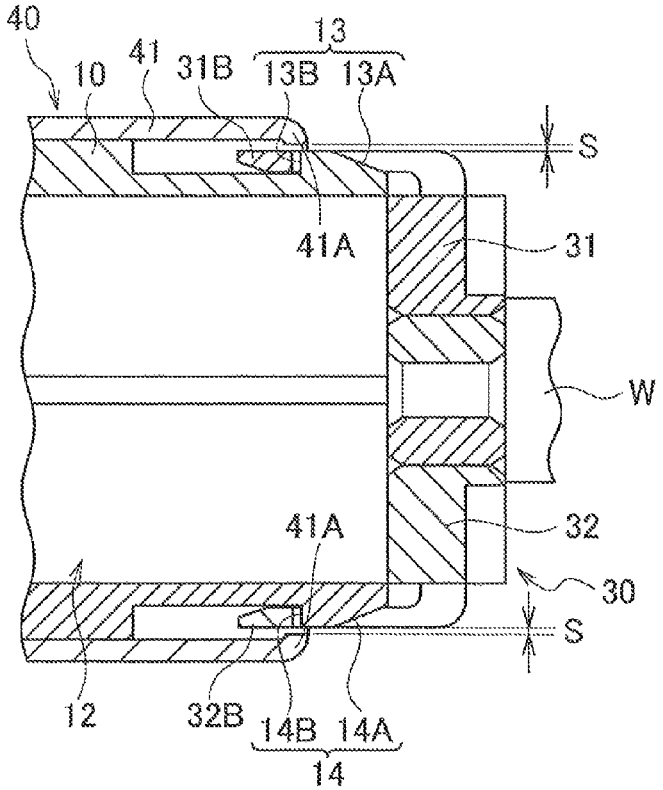
FIG. 3 is a cross-sectional view illustrating a proper assembly state of the connector according to the embodiment.

As illustrated in FIGS. 1 to 3, the connector 1 includes: a housing 10 that accommodates the terminals T provided on end portions of the wires W; a front holder 20 mounted at the forward of the housing 10; a rear holder 30 mounted at the rearward of the housing 10; and a shield shell 40 mounted on an outer periphery of the housing 10 to which the rear holder 30 has been mounted.

The housing 10 is formed of an insulating material (such as synthetic resin). The housing 10 includes terminal housing chambers 11 that accommodate the terminals T therein and wire housing chambers 12 communicated with the terminal housing chambers 11 in which the wires W are arranged.

A packing 50 is mounted on the outer periphery of the terminal housing chambers 11. The packing 50 is formed of an elastic material (such as rubber). The packing 50 provides waterproofing by contacting the case body (not illustrated) and the housing 10 in a state in which the case body (not illustrated) that accommodates the power electronic circuit to which the terminals T are electrically connected and the housing 10 are fitted.

Rubber plugs 60 are arranged on the outer periphery of the wires W arranged within the wire housing chamber 12. The rubber plugs 60 provide waterproofing by contacting the interior surface of the wire housing chambers 12 and the outer periphery of the wires W.

A first locking pawl 13 and a second locking pawl 14 each as a locking part are provided at the exterior surface (the upper side and the lower side) of the wire housing chamber 12. The first locking pawl 13 includes: a first tapered face 13A that causes a first locking frame 31B of the rear holder 30 to be elastically deformed and guide the first locking frame 31B of the rear holder 30; and a first locking face 13B that engagingly locks the first locking frame 31B that has been guided by the first tapered face 13A. The second locking pawl 14 includes: a second tapered face 14A that causes a second locking frame 32B of the rear holder 30 to be elastically deformed and guides the second locking frame 32B of the rear holder 30; and a second locking face 14B that engagingly locks the second locking frame 32B that has been guided by the second tapered face 14A.

The front holder 20 is formed of an insulating material (such as synthetic resin). At the front holder 20, terminal insertion holes 21 through which the tip of the terminals T are inserted are formed. The front holder 20 closes openings of the terminal housing chambers 11 of the housing 10 in a state that the tip of the terminals T protrude from the terminal insertion holes 21. The front holder 20 positions the tip of the terminals T by locking portions (not illustrated) such as lances and prevents the terminals T from falling off the housing 10. The front holder 20 also prevents the packing 50 from dropping off.

The rear holder 30 is formed of an insulating material (such as synthetic resin). The rear holder 30 includes a pair of a first divided body 31 and a second divided body 32 which are mutually combined into one. The first divided body 31 and the second divided body 32 include first wire supporting grooves 31A and second wire supporting grooves 32A each having a semicircular shape which support the wires W in a mutually combined state; and the first locking frame 31B and the second locking frame 32B each as a locked part. The first locking frame 31B protrudes toward the housing 10 and is locked to or unlocked from the first locking pawl 13 by elastic deformation. The second locking frame 32B protrudes toward the housing 10 and is locked to or unlocked from the second locking pawl 14 by elastic deformation. The first divided body 31 and the second divided body 32 are mutually assembled so as to hold the wires W at the rearward of the rubber plugs 60 and prevent the rubber plugs 60 from dropping off the housing 10.

The shield shell 40 is formed of a metal material (such as aluminum or its alloy) so as to prevent intrusion and leakage of electromagnetic noise and the like. As illustrated in FIG. 2, the shield shell 40 includes a cylindrical part 41 and a flange part 42.

As illustrated in FIG. 3, the cylindrical part 41 is arranged at a region where the first locking frame 31B and the second locking frame 32B are capable of elastic deformation (hereinafter referred to as an elastic deformation region) in an assembling process of the rear holder 30 to the housing 10, and includes a rear end portion 41A as an unlocking obstruction part which obstructs elastic deformation of the first locking frame 31B and the second locking frame 32B. The rear end portion 41A is arranged above the first locking face 13B and the second locking face 14B. That is, the cylindrical part 41 covers the locking position between the first locking face 13B and the first locking frame 31B, and the locking position between the second locking face 14B and the second locking frame 32B.

Figure 4:
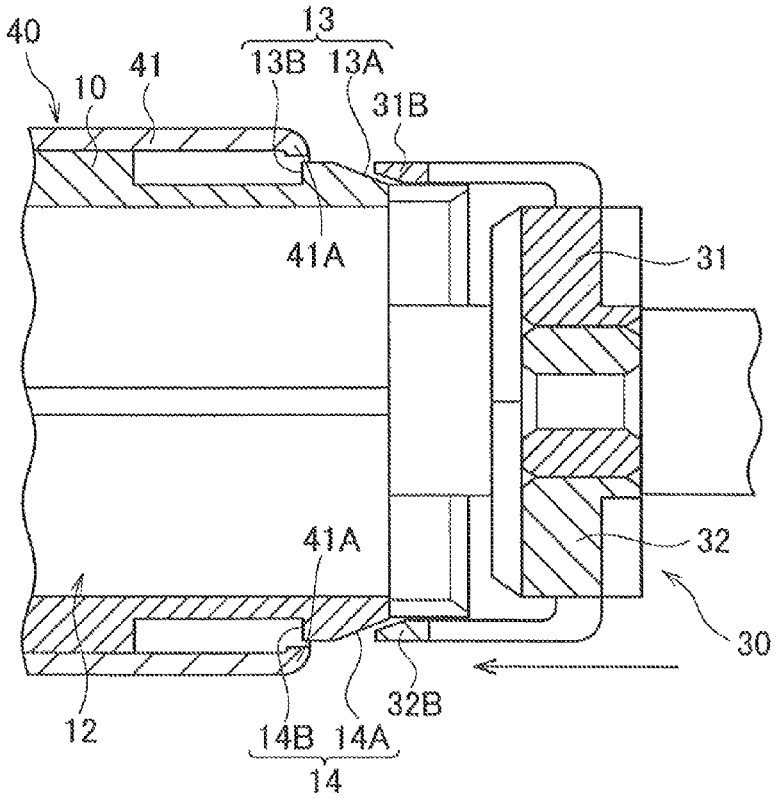
FIG. 4 is a cross-sectional view illustrating a state incapable of assembling in the connector according to the embodiment.
Figure 5:
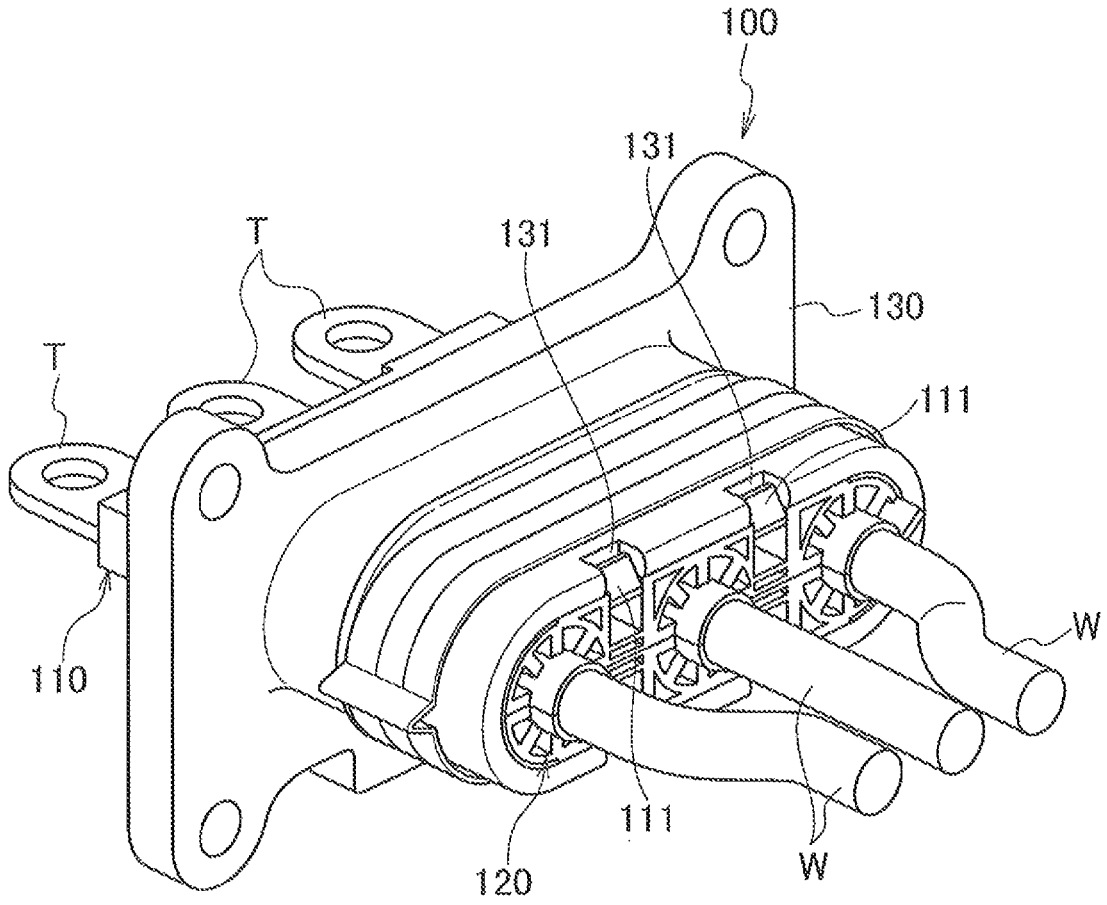
FIG. 5 PRIOR ART
FIG. 5 is a perspective view illustrating a connector according to a conventional example.

A space S between the interior surface of the cylindrical part 41 and the upper surface of the first locking pawl 13 and of the second locking pawl 14 is made smaller than the thickness of the first locking frame 31B and of the second locking frame 32B. Thus, for example, as illustrated in FIG. 4, in a case when the shield shell 40 is mounted to the housing 10 before the rear holder 30 is mounted to the housing 10, since the first locking frame 31B and the second locking frame 32B interfere with the rear end portion 41A, it is made such that the first locking frame 31B and the second locking frame 32B of the rear holder 30 do not enter within the space S and the rear holder 30 cannot be mounted to the housing 10. In other words, the rear holder 30 has to be mounted to the housing 10 before the shield shell 40 is mounted to the housing 10.

Next, an assembly process of the connector 1 will be explained.

As illustrated in FIGS. 1 and 2, each part (the front holder 20, rear holder 30, shield shell 40, packing 50, and rubber plugs 60) is assembled to the housing 10. At this time, as illustrated in FIG. 3, the shield shell 40 is mounted to the housing 10 after the rear holder 30 is mounted to the housing 10. Thus, the rear end portion 41A of the shield shell 40 is arranged at the elastic deformation region of the first locking frame 31B and the second locking frame 32B, and obstructs elastic deformation of the first locking frame 31B and the second locking frame 32B.

Here, in a case when the shield shell 40 is mounted to the housing 10 of the connector 1 before the rear holder 30 is mounted to the housing 10, as illustrated in FIG. 4, the first locking frame 31B and the second locking frame 32B interfere with the rear end portion 41A and the rear holder 30 cannot be mounted to the housing 10. That is, it becomes impossible to lock the first locking pawl 13 with the first locking frame 31B, and to lock the second locking pawl 14 with the second locking frame 32B.

As explained above, with the connector 1 according to the embodiment, it is possible to prevent releasing of the engagement state between the first locking pawl 13 and the first locking frame 31B, and releasing of the engagement state between the second locking pawl 14 and the second locking frame 32B due to external force and the like, by the rear end portion 41A of the shield shell 40 obstructing elastic deformation of the first locking frame 31B and the second locking frame 32B.

Moreover, since the rear end portion 41A of the shield shell 40 is arranged at the elastic deformation region of the first locking frame 31B and the second locking frame 32B, when the shield shell 40 is mounted to the housing 10 before the rear holder 30 is mounted to the housing 10, the first locking frame 31B and the second locking frame 32B interfere with the rear end portion 41A, and the rear holder 30 cannot be mounted to the housing 10. That is, it becomes impossible to lock the first locking pawl 13 with the first locking frame 31B and to lock the second locking pawl 14 with the second locking frame 32B. Therefore, the rear holder 30 has to be mounted to the housing 10 before mounting the shield shell to the housing 10, and at this time, the engagement state between the first locking pawl 13 and the first locking frame 31B and the engagement state between the second locking pawl 14 and the second locking frame 32B can be grasped, and it can be easily determined whether or not the rear holder 30 has been completely mounted to the housing 10. Further, it is possible to determine that the rear holder 30 is not completely mounted to the housing 10 at a point when the shield shell 40 cannot be mounted to the housing 10.

Moreover, at the time of mounting the shield shell 40 to the housing 10, even if mounting of the rear holder 30 to the housing 10 is insufficient (that is, the engagement between the first locking pawl 13 and the first locking frame 31B, and the engagement between the second locking pawl 14 and the second locking frame 32B are insufficient), the shield shell 40 is capable of interfering with the first locking frame 31B and the second locking frame 32B to press them forward. Therefore, the first locking frame 31B is securely guided to the first locking face 13B and the second locking frame 32B is securely guided to the second locking face 14B respectively. As a result, the rear holder 30 also can be securely mounted to the housing 10 at the time of mounting the shield shell 40 to the housing 10.

As described above, it is possible to determine the mutual locking state easily without releasing the engagement between the first locking pawl 13 of the housing 10 and the first locking frame 31B of the rear holder 30, and the engagement between the second locking pawl 14 and the second locking frame 32B of the rear holder 30.

In the connector 1 according to the embodiment, the rear end portion 41A of the shield shell 40 is provided above the first locking face 13B of the first locking pawl 13 and the second locking face 14B of the second locking pawl 14. Thus, even in a state in which the engagement position between the first locking pawl 13 and the first locking frame 31B and the engagement position between the second locking pawl 14 and the second locking frame 32B are not exposed outside, the base side of the first locking frame 31B and the second locking frame 32B can be visually observed. Therefore, even after the shield shell 40 is mounted to the housing 10, it is possible to grasp that the first locking pawl 13 and the first locking frame 31B, and the second locking pawl 14 and the second locking frame 32B have been locked.

In the connector 1 according to the embodiment, the space S between the interior surface of the cylindrical part 41 of the shield shell 40 and the tip of the first locking pawl 13 and the second locking pawl 14 is smaller than the thickness of the first locking frame 31B and the second locking frame 32B. Therefore, when the shield shell 40 is mounted to the housing 10 before the rear holder 30 is mounted to the housing 10, the first locking frame 31B and the second locking frame 32B are prevented from entering inside the shield shell 40 from the space S.

As described above, the content of the present application has been disclosed through the embodiment. However, the description and drawings that constitute a part of this disclosure should not be understood as something that limits the present application. From this disclosure, various alternative embodiments, examples and operation technology become apparent for a person skilled in the art.

For example, the embodiment can be altered as follows. Specifically, it was explained that the first locking pawl 13 and the second locking pawl 14 each as the locking part are provided on the housing 10 and the first locking frame 31B and the second locking frame 32B each as the locked part are provided on the rear holder 30. However, it is not limited to this, and the locking part may be provided on the rear holder 30 and the locked part may be provided on the housing 10. Further, the shape, arranging place and number of the first locking pawl 13, the second locking pawl 14, the first locking frame 31B, and the second locking frame 32B can be set arbitrarily.

Moreover, it was explained that the rear end portion 41A of the shield shell 40 is provided above the first locking face 13B and the second locking face 14B. However, it is not limited to this, and it is sufficient as long as it can obstruct elastic deformation of the first locking frame 31B and the second locking frame 32B (that is, as long as it is arranged at the elastic deformation region). For example, it may be provided at a forward position than the first locking face 13B and the second locking face 14B.

Furthermore, it was explained that the space S between the interior surface of the cylindrical part 41 of the shield shell 40 and the tip of the first locking pawl 13 and the second locking pawl 14 is made smaller than the thickness of the first locking frame 31B and the second locking frame 32B. However, it is not limited to this, and it may be larger than the thickness of the first locking frame 31B and the second locking frame 32B. In this case, for example, protrusions or the like that protrude inward may be provided on the rear end portion 41A of the shield shell 40 and the first locking frame 31B and the second locking frame 32B may be made to interfere with the protrusions or the like so as to prevent their entry from the space S.

As such, naturally the present application includes various embodiments that are not described here. Therefore, technical scope of the present application is only determined by matters used to specify the invention according to the claims that are reasonable from the above explanations.

What is claimed is:

1. A connector, comprising:

a housing which accommodates terminals connected to end portions of wires therein and which has a locking part on an exterior surface of the housing;

a rear holder having a locked part to be locked with or unlocked from the locking part by elastic deformation, wherein the rear holder is mounted on a side of the housing where the wires are extended, and prevents a waterproofing member that contacts an outer periphery of the wires from dropping off the housing; and a shield shell mounted on an outer periphery of the housing to which the rear holder has been mounted, wherein the shield shell includes an unlocking obstruction part that is arranged at an elastic deformation region of the locked part in an assembling process of the rear holder to the housing and the shield shell and obstructs the elastic deformation of the locked part.

2. The connector according to claim 1, wherein the locking part includes a tapered face that causes the locked part elastically deformed and guides the locked part, and a locking face that engages with the locked part that has been guided by the tapered face, and the unlocking obstruction part is arranged above the locking face.

3. The connector according to claim 1, wherein a space between an interior surface of the shield shell and a tip of the locking part is made smaller than a thickness of the locked part.

* * * * *